US011047138B2

(12) United States Patent
Hering et al.

(10) Patent No.: US 11,047,138 B2
(45) **Date of Patent: *Jun. 29, 2021**

(54) MODULAR SPRUNG FLOOR

(71) Applicants: Spencer Gavin Hering, Miami, FL (US); Manuel Reyes, Newport, RI (US); Chase Crawford, Newport, RI (US); Zachary Schulze, Newport, RI (US)

(72) Inventors: Spencer Gavin Hering, Miami, FL (US); Manuel Reyes, Newport, RI (US); Chase Crawford, Newport, RI (US); Zachary Schulze, Newport, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/813,450

(22) Filed: Mar. 9, 2020

(65) Prior Publication Data

US 2020/0354974 A1 Nov. 12, 2020

Related U.S. Application Data

(63) Continuation-in-part of application No. 16/407,348, filed on May 9, 2019, now Pat. No. 10,731,359.

(51) Int. Cl.
*E04F 15/22* (2006.01)

(52) U.S. Cl.
CPC ..... *E04F 15/225* (2013.01)

(58) Field of Classification Search
CPC ..... E04F 15/225; E04F 15/22
USPC ..... 52/403.1
See application file for complete search history.

(56) References Cited

U.S. PATENT DOCUMENTS 1,789,576 A * 1/1931 Bowman ..... E04F 15/14 52/318
2,263,895 A * 11/1941 Larsen ..... E04F 15/22 52/402
2,743,487 A * 5/1956 Kuhlman ..... E04F 15/22 52/402
2,823,427 A * 2/1958 Kuhlman ..... E04F 15/225 52/402
3,710,733 A * 1/1973 Story ..... E04C 2/22 108/57.28
4,023,530 A * 5/1977 Cobb ..... A01K 31/007 119/480
4,443,989 A * 4/1984 Silvey ..... E04F 15/22 52/393
4,590,731 A * 5/1986 DeGooyer ..... E04C 5/04 52/388
4,813,672 A * 3/1989 Stille ..... A63B 69/0013 405/302.7

(Continued)

*Primary Examiner* — James M Ference
(74) *Attorney, Agent, or Firm* — Keeley DeAngelo LLP; W Scott Keeley

(57) ABSTRACT

A method, system and apparatus for a modular sprung floor. An example embodiment is a sprung floor module having interchangeable components. Interchangeable components make up standardized assemblies. An example embodiment has a frame module that may be installed in a series to cover a given area. The frame and edge modules comprise a frame that supports a performance surface. Standardized components include fiber-reinforced composite linear-structural members combined with elastomeric joints and support members.

3 Claims, 7 Drawing Sheets

(56) References Cited

U.S. PATENT DOCUMENTS

| | | | | | |
|---|---|---|---|---|---|
| 4,854,099 | A * | 8/1989 | Kristoffersen | E04F 15/18 | 52/403.1 |
| 5,365,878 | A * | 11/1994 | Dyer | A01K 31/007 | 119/347 |
| 5,581,965 | A * | 12/1996 | Jorgensen | E04F 15/22 | 52/403.1 |
| 5,664,378 | A * | 9/1997 | Bettigole | E01D 19/125 | 404/134 |
| 5,820,299 | A * | 10/1998 | Anderson | F16L 1/24 | 405/172 |
| 7,144,609 | B2 * | 12/2006 | Reddick | C09K 17/40 | 428/17 |
| 7,587,865 | B2 * | 9/2009 | Moller, Jr. | E01C 5/20 | 52/177 |
| 10,329,777 | B2 * | 6/2019 | Hering | E04F 15/22 | |
| 2005/0205749 | A1 * | 9/2005 | Campbell | F16F 1/371 | 248/633 |
| 2018/0313097 | A1 * | 11/2018 | Hering | E04F 15/22 | |
| 2020/0190830 | A1 * | 6/2020 | Hering | E04F 15/225 | |
| 2020/0354974 | A1 * | 11/2020 | Hering | E04F 15/225 | |

* cited by examiner

100

132

130

MODULAR SPRUNG FLOOR

This application is a continuation-in-part application of U.S. patent application Ser. No. 16/407,348 filed 2019 May 9.

TECHNICAL FIELD

The present disclosure relates to modular floor systems and impact and shock-absorbing floors.

BACKGROUND

A sprung floor is a floor that is designed to absorb impact or vibration. Such floors are used for dance and indoor sports, martial arts and physical education to enhance performance and reduce injury. Impact injuries and repetitive stress injuries are mitigated by sprung floors.

Sprung-floor requirements are similar for dance or sports. Aspects of sprung floors include: stability; balance; flatness; flexion to prevent injuries without being so soft as to cause fatigue; sufficient traction to avoid slipping without causing one's foot to twist due to excessive grip.

Common construction methods include woven slats of wood or wood with high-durometer rubber pads between the wood and sub-floor, or a combination of the woven slats with rubber pads. Some sprung floors are constructed as permanent structures while others are composed of modules that slot together and can be disassembled for transportation. When constructed, a gap is left between the sprung floor and walls to allow for expansion and contraction of the sprung-floor materials.

The surface of a sprung floor is referred to as the performance surface and may be constructed of either a natural material such as solid or engineered wood or may be synthetic such as vinyl, linoleum or other polymeric construction. The surface upon which a sprung floor is installed is referred to as the sub-floor.

Some pads or shock absorbers used in sprung-floor construction are made of rubber or elastic polymers. The term elastic polymer is commonly referred to as rubber. Elastomers are amorphous polymers having viscosity and elasticity with a high failure strain compared to other polymers. Rubber is a naturally occurring substance that is converted into a durable material through the process of vulcanization. Elastomers or elastomeric materials may be thermosets or thermoplastic. A thermoset material is formed and set with a heating process. Thermoset materials do not return to their liquid state upon re-heating. Thermoplastic materials return to a liquid state when subject to sufficient heat. Thermoplastic materials may be injection-molded while thermoset materials are commonly molded in low-pressure, foam-assisted molds or are formed in stock material that may be die-cut or machined.

Bending stiffness, also referred to as flexural rigidity, may be understood to be the result of a material's elastic modulus (E) multiplied by the area moment of inertia (I) of a beam cross-section, E*I. Bending stiffness or flexural rigidity may be measured in Newton millimeters squared (N*mm^2) A beam is also referred to as an elongate member.

SUMMARY

In accordance with example embodiments of the present disclosure, a method, system and apparatus for a modular sprung-floor is disclosed. An example embodiment is a sprung floor module having interchangeable components.

Interchangeable components make up standardized assemblies. An example embodiment has a frame module that may be installed in a series to cover a given area. The frame module supports a performance surface. Standardized components include linear structural members combined with elastomeric joints and support members. Linear structural members may be hollow rectangular tubes.

One skilled in the art is familiar with hollow rectangular structural members made of steel, aluminum, fiber-reinforced polymers and the like. Manufacturing methods include casting, extruding, pultrusion, laminate molding and the like. Material properties vary as to the type of material, direction of fibers of a composite and the shape of the cross section. Cost of materials and weight are dependent on specific requirements of applications. For example, fiber-reinforced structural members may be appropriate for a modular system that must be rapidly assembled, disassembled and moved, whereas a permanent installation may utilize wood, composite, polymer, aluminum or steel structural members for reasons of durability and cost.

Frame modules are made up of linear-structural members arranged in a grid pattern having X-axis frame members and Y-axis frame members. Vertical joints are standardized components of an elastomeric material that join linear-structural members at right angles where X-axis frame members meet Y-axis frame members. These joints join structural members to form a frame while damping vibration and impact.

Other elastomeric members engage with X-axis or Y-axis frame members and movably engage with linear, structural channels that are fastened to edges of adjacent performance-surface panels. Linear, structural channels join edges of performance-surface panels and support the performance surface atop elastomeric members. These linear, structural channels join together frame modules while aligning and connecting performance surface panels, and in some embodiments have a U-shaped cross section. The performance surface is made up of flat panels joined to linear, structural channels at adjacent edges, allowing for removal of a single panel in an array, by removing the fasteners that join the edges to the structural channels. In some embodiments, performance-surface panel joints do not align with frame-module joints. Linear, structural channels provide a way of joining together performance-surface panels across frame module seams. The linear, structural channels also allow the performance surface to float atop the elastomeric supports so that the performance surface may expand and contract in varying environmental conditions without stressing the materials. Elastomeric supports between frame modules and linear, structural channels damp vibrations between performance surface panels and frame modules.

To join grid modules together, elastomeric pads and brackets are installed to abutting elongate members, forming a lateral joint. The elastomeric pads transmit load from a performance surface perpendicularly to these joints.

Weight on the performance surface creates a perpendicular force that transmits a compressive force on the top of elongate members, and a tensile force on the bottom of the elongate members. Within a joint, the tops of the abutting elongate members push into each other, supporting the compressive load.

The bottoms of the elongate members in a joint have the tendency to spread apart when under load. The brackets hold the bottoms of the elongate members together. The perpendicular force from the performance surface imparts a tensile force to the brackets holding them together and preventing spreading.

One skilled in the art understands that there are various methods for manufacturing elastomeric forms. In some embodiments the joint and support components are injection-molded. In other embodiments, elastomeric components may be manufactured by a low-pressure molding process using foamed urethane. In still other embodiments sheet metal components may be cut from stock material and bent. One skilled in the art also understands that elastomeric components may be placed between frame members and a sub-floor.

Other objects and features will become apparent from the following detailed description considered in conjunction with the accompanying drawings. It is to be understood, however, that the drawings are designed as an illustration and not as a definition of the limits of the invention.

BRIEF DESCRIPTION OF THE DRAWINGS

To assist those of skill in the art in making and using the disclosed floor system and associated methods, reference is made to the accompanying figures, wherein.

DESCRIPTION

Figure 1:
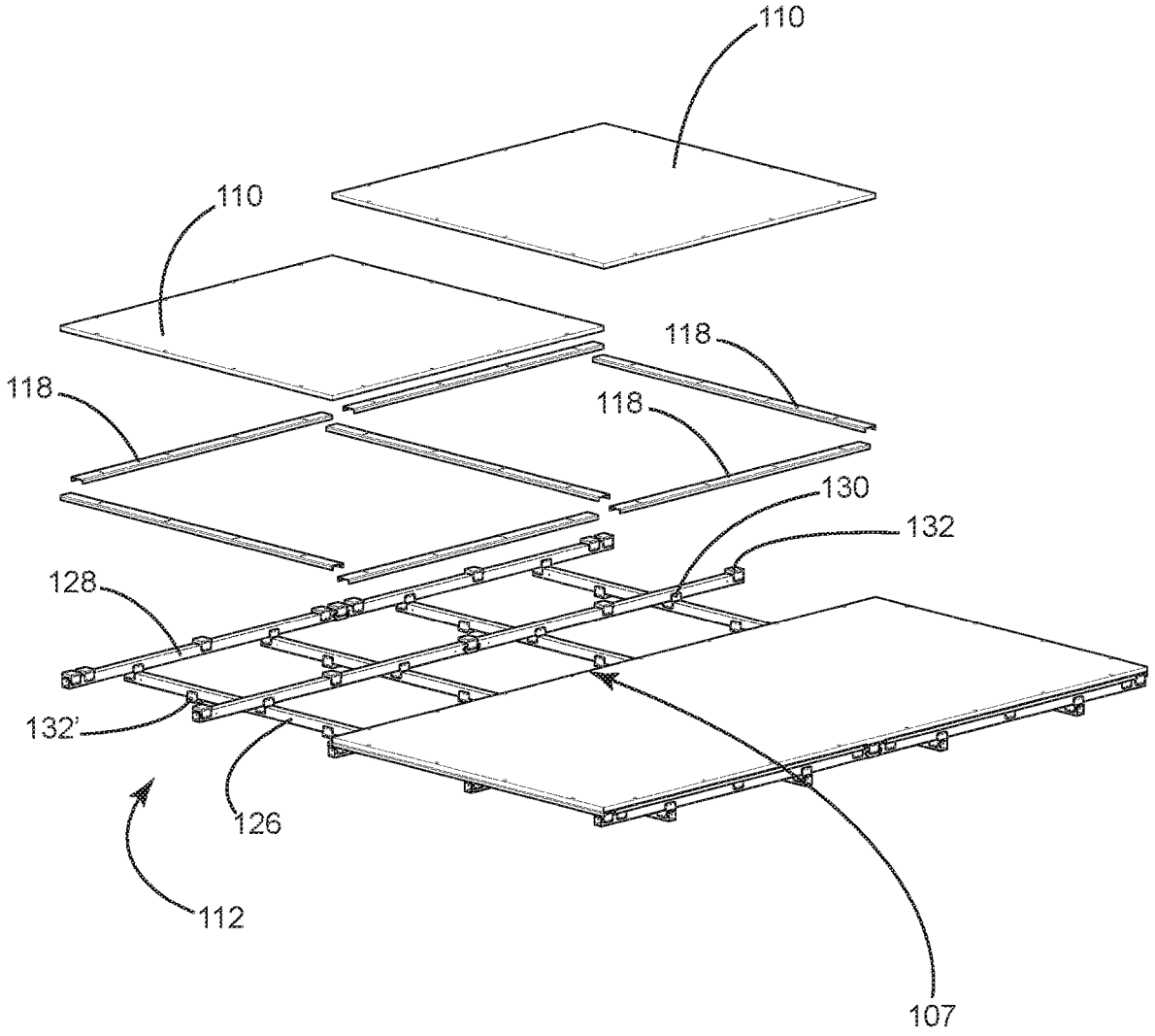
FIG. 1 is a perspective, partially exploded view of the embodiment 100.

The present disclosure relates to a modular sprung floor assembly 100. A frame assembly 112 forms a grid, made up of X-axis frame members 126 and Y-axis frame members 128 that are joined at nodes by frame joints 130. A performance surface, made up of performance-surface panels 110 is supported above the frame assembly by linear, structural channels 118 that reside atop performance-surface supports 132, also referred to as pads. Pads are also used in an inverted orientation 132' to support the frame assembly above a subfloor. Linear, structural channels 118 are fastened with fasteners, about the perimeter of performance-surface panels 110, joining edges of performance-surface panels 110 firmly. By resting atop performance-surface supports 132 the performance-surface panels 110 float and shift freely over the supports 132 as the floor expands and contracts with environmental conditions, allowing seams between performance-surface panels 110 to remain tight and unstressed without the need for edge fastening such as tongue-and-groove edge treatment. Performance-surface panels 110 may be removed individually, anywhere in an array, by removing fasteners and lifting a panel 110. At some joints, the short edges of square panels meet a long edge 107 of an adjacent panel.

Figure 2:
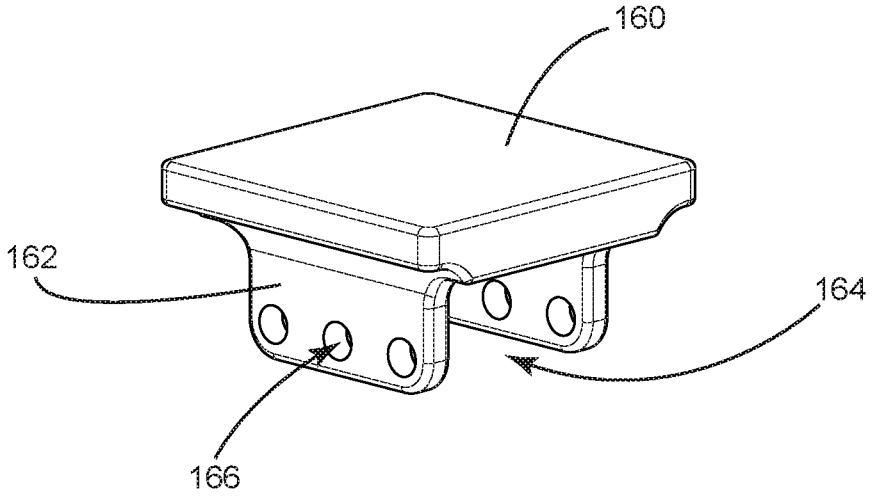
FIG. 2 is a perspective view of a pad (performance-surface support).

FIG. 2 is a perspective view of a performance-surface support or pad 132 with a top surface 160 and side surfaces 162. Top surface 160 is designed to slidably engage with linear, structural channels 118 (FIG. 1). An aperture 164 accepts X-axis frame members 126, (FIG. 1). Fastener-holes 166 affix fasteners to X-axis frame members 126. One skilled in the art understands that 132 inverted (132', FIG. 1) can serve as a pad between the Y-axis members and a sub-floor.

Figure 3:
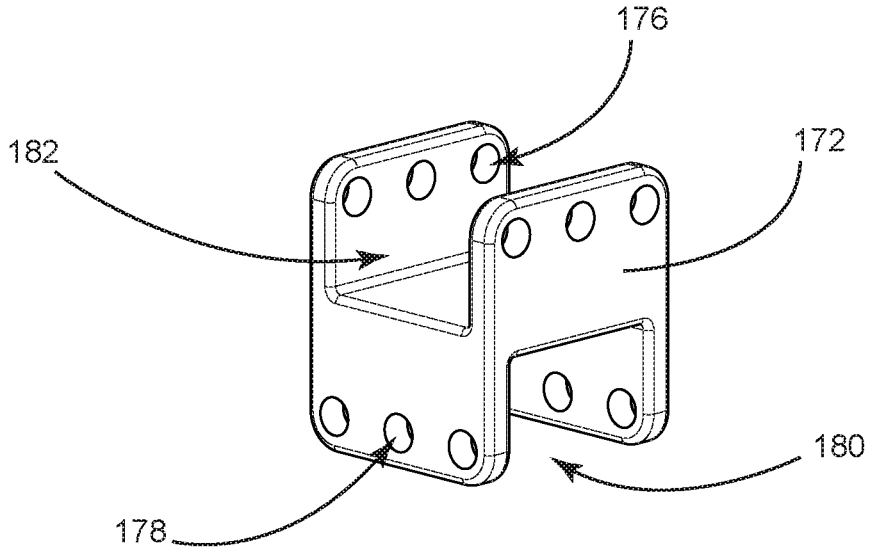
FIG. 3 is a perspective view of a frame joint.

FIG. 3 shows a frame joint 130 which connects X-axis frame members 126 and Y-axis frame members 128 stacked at right angles in the frame assembly (FIG. 1). Aperture 182 is parallel to the frame joint's front surface 172 and receives X-axis frame members 126 (FIG. 1). Aperture 180 accepts Y-axis frame members 128 (FIG. 1). Fastener-holes 176, 178 are for affixing fasteners to X-axis frame members 126 and Y-axis frame members 128 respectively.

Figure 4:
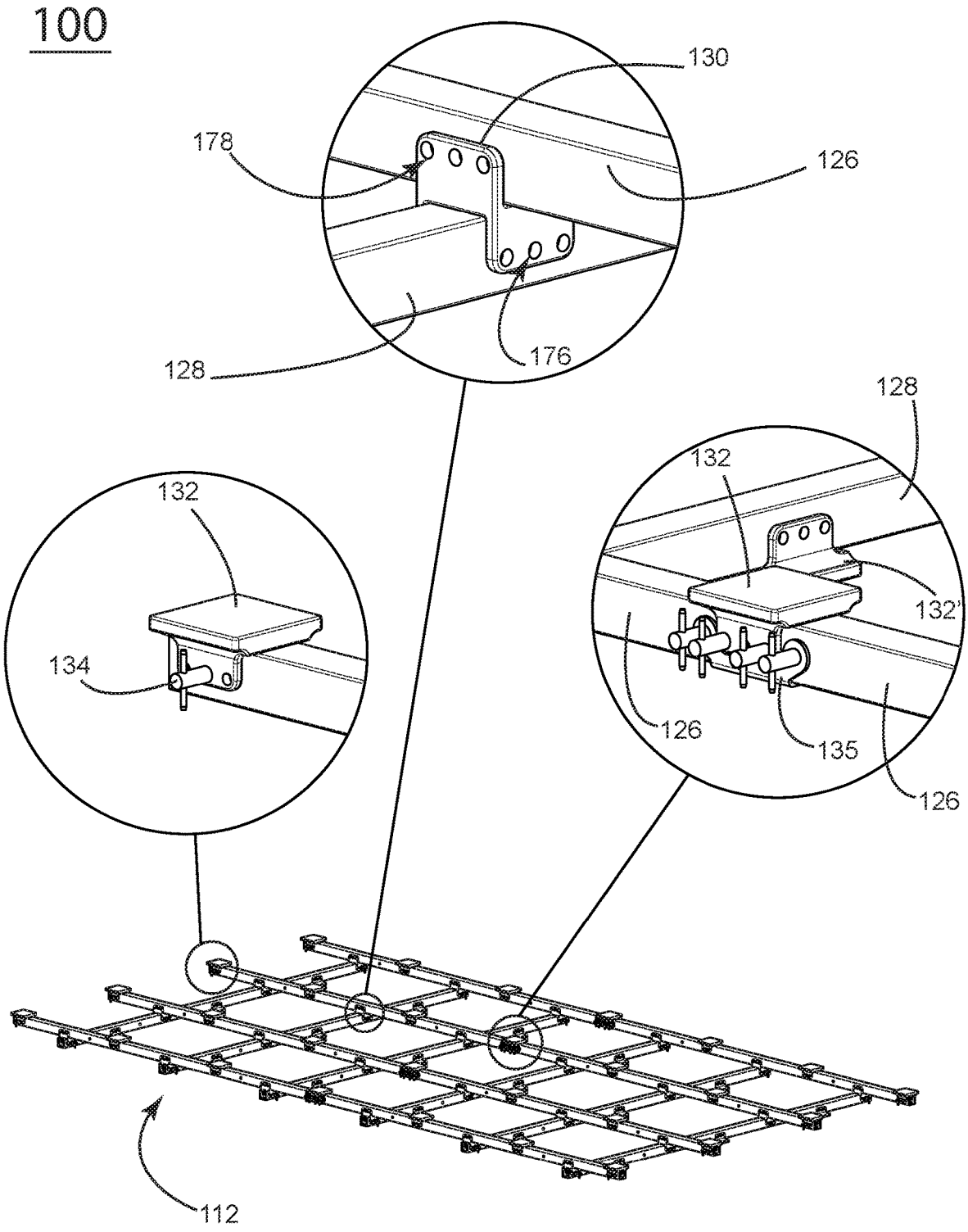
FIG. 4 is a perspective, detailed view of the pad of FIG. 2 and the frame joint of FIG. 3 shown assembled in the embodiment 100.

FIG. 4, 100 shows the pad 132 of FIG. 2 and the frame joint 130 of FIG. 3 installed on a frame assembly 112. Elastomeric pads 132 in their upright position support linear, structural channels 118 (FIG. 1) and performance-surface panels 110 (FIG. 1). One skilled in the art understands the various types of laminate material that may be used as a performance surface. Inverted, the elastomeric pads 132' support Y-axis frame members 128 and offset those members from a sub-floor. One skilled in the art understands that the same part may be used for both purposes; in the example of elastomeric pads 132 and elastomeric pads 132' the same manufactured part is used in an upright orientation of the pad 132 and in an inverted orientation of the pad 132,' performing different functions: one adheres the channels 118 (FIG. 2) and hence the frame assembly, another adheres to the performance surface while damping vibrations, and another damps vibrations against a sub-floor. The frame joint 130 accepts X-axis frame members 126 and Y-axis frame members 128 at right angles.

A bracket 135 has an inverted U-shaped cross-section. It serves to join the X-axis frame members 126 end to end. At least one pin 134 may be used to fasten the bracket 135 to an X-axis frame member 126.

Fastener holes 176 are configured to affix the frame joint 130 to X-axis frame members 126 with the use of common fasteners. Fastener holes 178 are configured to affix the frame joint 130 to Y-axis frame members 128.

Figure 5:
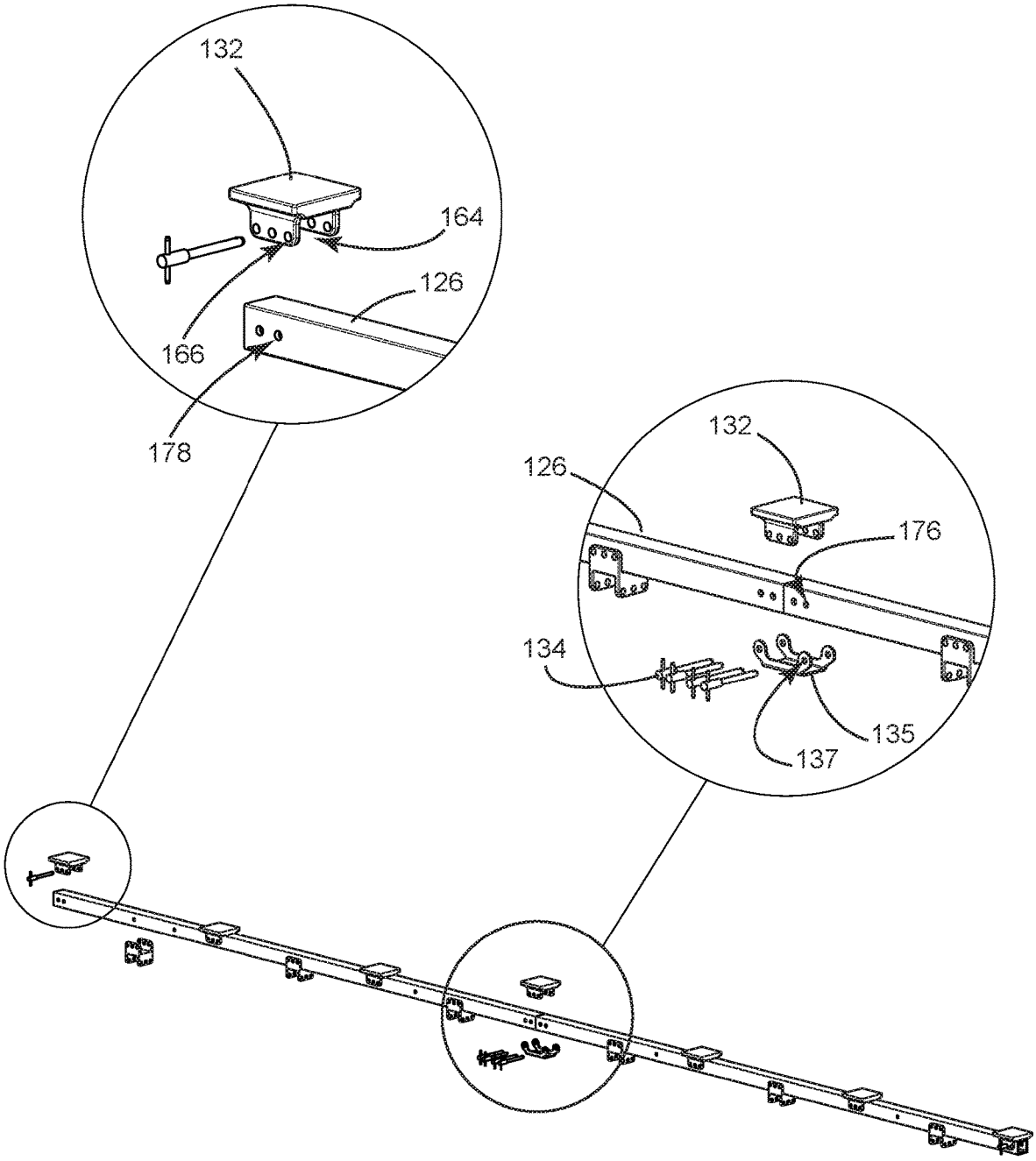
FIG. 5 is a perspective, detailed and partially exploded view of a pad and a bracket shown installed.

FIG. 5 illustrates how the elastomeric pads 132 install on the frame assembly. In their upright position the pads support structural channels (FIG. 6, 118) and performance-surface panels (FIG. 6, 110) of a sprung floor. One skilled in the art understands that this grid structure may support a performance surface of a sprung-floor assembly similar to that of FIG. 1.

A bracket 135 has an inverted U-shaped cross-section. It serves to join the x-axis frame members 126 end to end. Fastener holes 137 through the bracket 135 match those 176 of the frame members 126. At least one pin 134 may be used to fasten the bracket 135 to a frame member 126. Fastener holes 137 in the pad 132 match those 176 of the frame members and may be used to fortify this joint. Perpendicular force transmits a tensile force to the brackets, which hold the elongate members together from the bottom.

Figure 6:
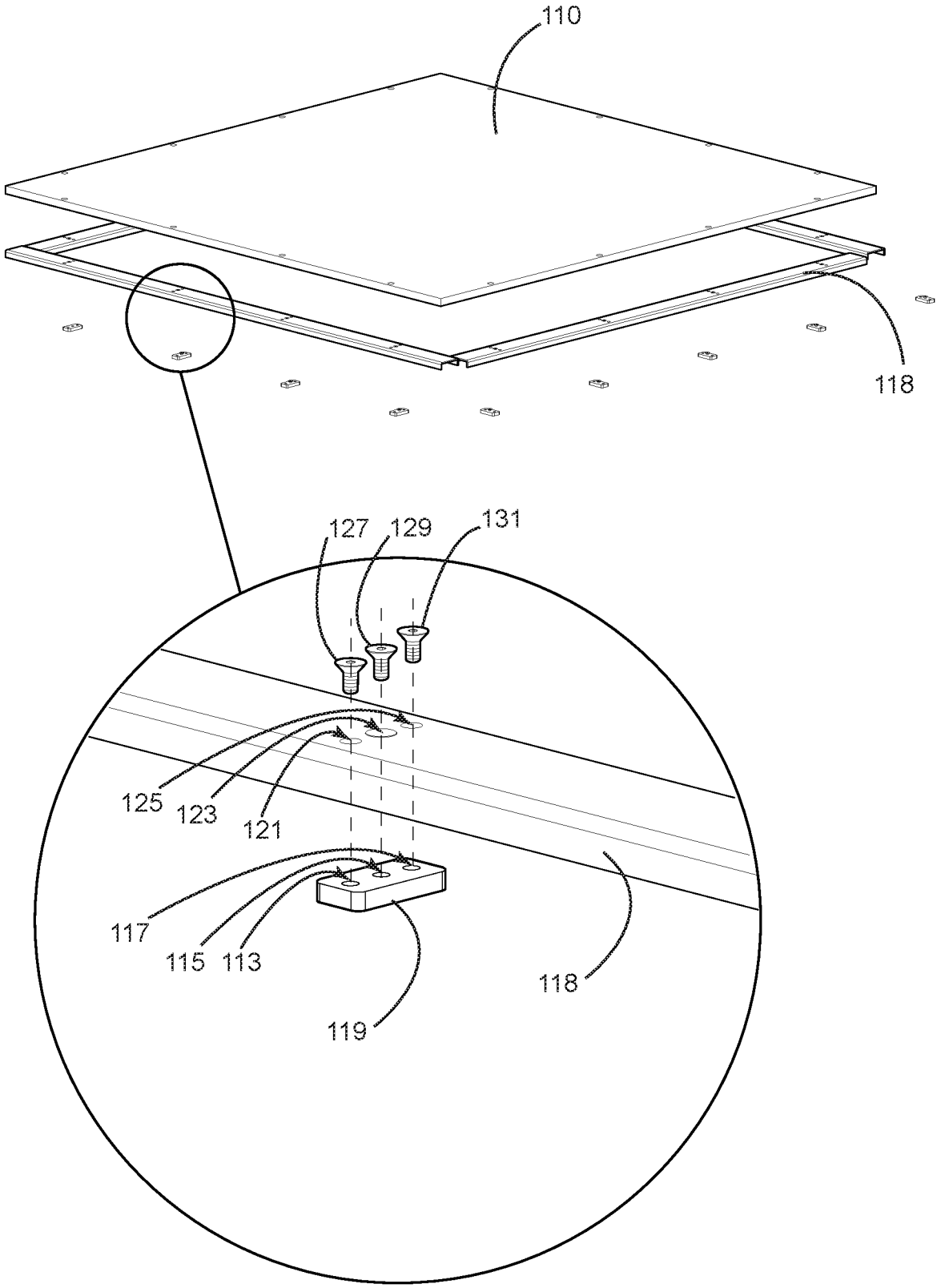
FIG. 6 is a perspective, partially exploded view of the embodiment 100

FIG. 6 illustrates the assembly of an example linear, structural channel 118 and an example performance-surface panel 110. An insert 119 having three fastener holes 113, 115 and 117 is placed on the underside of a linear, structural channel 118. The insert is affixed to the structural channel with a fastener 129 that passes through a hole 123 in structural channel 118 and fastened into fastener hole 115. Fastener 127 passes through a fastener hole in a first performance-surface panel 110, through hole 121 in a structural channel 118 and then fastened into fastener hole 113. One skilled in the art understands how a series of such fasteners arrayed along the edge of a first performance-surface panel 110 will affix the edge of the performance-surface panel 110 along the center of a structural channel 118.

Fastener 131 passes through a fastener hole in a second performance-surface panel, through hole 125 in a structural channel 118 and is fastened into fastener hole 117. One skilled in the art understands how a series of such fasteners arrayed along the edge of a second performance-surface panel will affix the edge of the second performance-surface panel along the center of a structural channel 118 and abut the edge of the first performance-surface panel 110. Panels fastened in this manner are fixedly engaged at their edges with structural channels and may be removed by removing the fasteners, without the need to remove multiple panels as when tongue-and-groove joints are used. Structural channels 118 are thus allowed to move about the top of pads 132 (FIG. 1) to allow for expansion and contraction of the performance surface during environmental changes.

Figure 7:
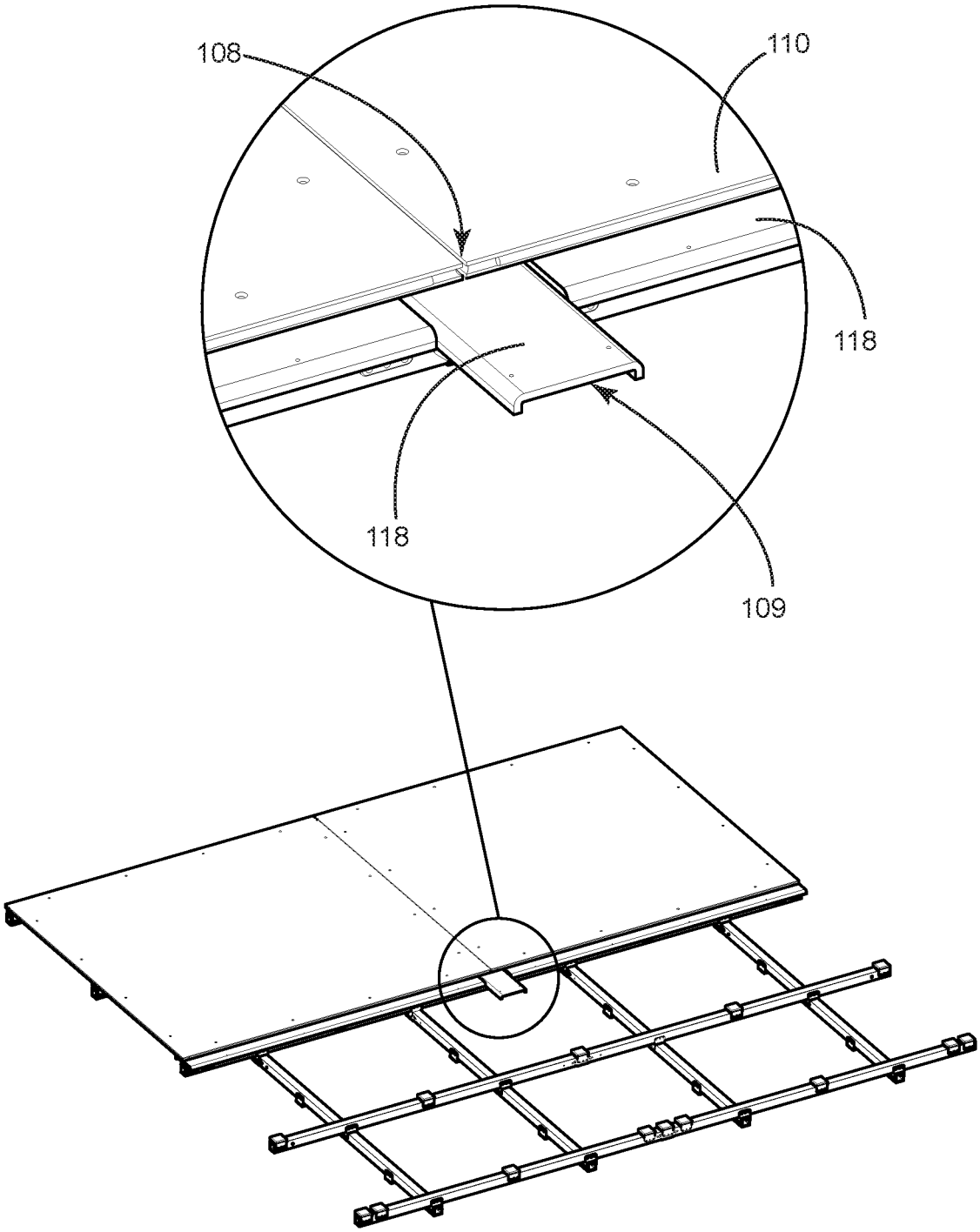
FIG. 7 is a perspective, partially exploded, detail view of the embodiment 100.

FIG. 7 illustrates a detail of the channel layout. In some embodiments, a channel 118 having an end 109 may extend past a joint 108 and into a long edge of a surface panel 107 (FIG. 1). By extending the channel end 109 into a surface panel long edge 107, the structural connection is extended and so, loading is distributed into the performance surface away from the joint 108.

The invention claimed is:

1. A modular grid structure for a sprung floor comprising:

at least two elongate members parallel to an X-axis; and at least two elongate members parallel to a Y-axis and perpendicular to said X-axis; and at least two elastomeric pads, each having a planar surface portion; and an aperture; and said at least two elastomeric pads fixedly engaged through said aperture, in an upright orientation, with said elongate members parallel to the X axis; and said at least two elastomeric pads fixedly engaged through said aperture, in an inverted orientation, with said elongate members parallel to the Y axis; and at least two frame-joint members having at least a first joint aperture and a second joint aperture; and said first and second joint apertures being perpendicular to each other; and said elongate members parallel to the X axis fixedly engaged through said first joint aperture; and said elongate members parallel to the Y axis fixedly engaged through said second joint aperture in said joint member; and at least one linear, structural channel having a first end and a second end, a right side and a left side and an elongate centerline extending from said first end to said second end; and a series of fastener holes through said linear structural channel, left of said elongate centerline, and right of said elongate centerline; and at least two performance-surface panels; and fasteners penetrating edges of one of said at least two performance-surface panels and fastener holes left of said elongate centerline; and fasteners penetrating edges of the other of said at least two performance-surface panels and fastener holes right of said elongate centerline; wherein said planar surface portion of said at least two elastomeric pads which are fixedly engaged, in an inverted orientation, with said elongate members parallel to the Y-axis being movably engaged with a sub-floor; and said planar portion of said at least two elastomeric pads which are fixedly engaged, in an upright orientation, with said elongate members parallel to the X-axis being movably engaged with said linear structural channel and said linear structural channel fixedly engaged with adjacent edges of said at least two performance-surface panels, said at least two performance-surface panels substantially covering said modular grid structure, providing a sprung floor.

2. The modular grid structure of claim 1 further comprising:

at least two elongate members to be joined end-to-end; and a bracket for joining the ends of elongate members, the bracket comprising:

an inverted U-shaped cross-section; and at least two through holes through said U-shaped cross section; wherein the bracket is engaged under the ends of a pair of elongate members, fasteners penetrate said through holes and said elongate members fixedly engaging said elongate members end-to-end.

3. The modular grid structure of claim 1 further comprising:

a first modular grid structure residing upon a sub-floor comprising:

at least four elongate members parallel with said X-axis are engaged with said frame joint members which are in turn engaged with at least four of said elongate members parallel to said Y-axis providing a first modular grid structure; and said at least four elongate members parallel to said Y-axis are each engaged, at one end, with a bracket, the brackets comprising:

inverted U-shaped cross sections; and at least two through holes through said inverted U-shaped cross sections; and providing a second grid structure residing upon a sub-floor; wherein at least four elongate members of said second grid structure, parallel to said Y-axis are engaged, at one end, with said brackets which are engaged with said first modular grid structure elongate members parallel to said Y-axis; wherein multiple modular grid structures provide a structure residing upon a sub-floor for supporting a performance surface of a sprung floor.

* * * * *